US010633864B2

(12) United States Patent
Dempster

(10) Patent No.: US 10,633,864 B2
(45) Date of Patent: Apr. 28, 2020

(54) SYSTEMS FOR WEATHERPROOF ROOF HATCH ASSEMBLIES

(71) Applicant: Air Distribution Technologies IP, LLC, Milwaukee, WI (US)

(72) Inventor: William S. Dempster, Grand Rapids, MI (US)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 42 days.

(21) Appl. No.: 15/868,826

(22) Filed: Jan. 11, 2018

(65) Prior Publication Data

US 2019/0211561 A1 Jul. 11, 2019

(51) Int. Cl.

| | |
|---|---|
| ***E04D 13/00*** | (2006.01) |
| ***E05F 1/10*** | (2006.01) |
| ***E06B 5/00*** | (2006.01) |
| ***E05F 1/00*** | (2006.01) |

(52) U.S. Cl.

CPC ..... *E04D 13/00* (2013.01); *E05F 1/004* (2013.01); *E05F 1/1091* (2013.01); *E06B 5/00* (2013.01); *E05Y 2900/154* (2013.01)

(58) Field of Classification Search

CPC ..... E04B 5/00; E06B 3/26347; E04D 13/00; E05F 1/1091; E05F 1/004

See application file for complete search history.

(56) References Cited

U.S. PATENT DOCUMENTS

| | | | | |
|---|---|---|---|---|
| 2,939,738 | A * | 6/1960 | Lyons | B63B 19/14 292/272 |
| 3,251,158 | A * | 5/1966 | Shapiro | E04D 13/0352 52/1 |
| 3,896,595 | A * | 7/1975 | Anghinetti | E05C 3/12 52/19 |
| 4,413,450 | A * | 11/1983 | Brower | E04D 13/0315 52/200 |
| 4,845,905 | A * | 7/1989 | Frank | E04D 13/0354 52/72 |
| 4,899,420 | A * | 2/1990 | Bye | E05D 7/121 16/16 |
| 4,941,300 | A * | 7/1990 | Lyons, Jr. | E04D 13/0315 52/200 |
| 5,123,875 | A * | 6/1992 | Eubank | F24F 7/025 236/44 C |

(Continued)

FOREIGN PATENT DOCUMENTS

EP 2383401 9/2016

*Primary Examiner* — James M Ference

(74) *Attorney, Agent, or Firm* — Fletcher Yoder, P.C.

(57) ABSTRACT

A roof hatch for enabling access to a rooftop of a building from an interior of the building includes a curb adapter configured to be disposed over a curb of the rooftop. The curb is formed around an opening in the rooftop that fluidly connects the interior of the building to an exterior of the building. Additionally, the roof hatch includes a cover coupled to the curb adapter by a pivoting member. The cover includes a support extending within an interior length of the cover. The roof hatch includes a gas spring coupled between the support and the curb adapter. The gas spring is configured to apply a force to the support, and the support is configured to distribute the force along the interior length of the cover.

26 Claims, 8 Drawing Sheets

(56) References Cited

U.S. PATENT DOCUMENTS 5,136,811 A * 8/1992 Lyons, Sr. ..... E05F 1/123 49/386
5,205,073 A * 4/1993 Lyons, Sr. ..... E02D 29/1418 49/379
5,373,665 A * 12/1994 Lyons, Sr. ..... E04D 13/0354 16/308
5,600,921 A * 2/1997 Vardaro ..... E05C 9/043 49/379
5,638,645 A * 6/1997 Lipton ..... E04D 13/0354 454/339
5,735,086 A * 4/1998 Fordahl ..... E04D 13/03 454/195
5,941,190 A * 8/1999 Kyle ..... B63B 19/14 114/201 R
5,960,596 A * 10/1999 Lyons, Sr. ..... E04D 13/1415 52/198
6,021,606 A * 2/2000 Kos ..... E02D 29/124 16/289
6,041,553 A * 3/2000 Joyce ..... E06B 5/01 49/504
6,347,818 B1 * 2/2002 Lyons, Sr. ..... E04D 13/0354 16/360
6,446,307 B2 * 9/2002 Wilkins ..... B65D 90/10 16/325
6,560,931 B1 * 5/2003 Cermola ..... E05F 1/1008 16/308
6,572,182 B2 * 6/2003 Lamparter ..... B60J 7/1642 296/216.02
6,672,020 B1 * 1/2004 Cermola ..... E04D 13/0315 52/200
6,681,528 B1 * 1/2004 Profeta ..... E04D 13/0335 182/113
6,688,046 B2 * 2/2004 Perkins ..... E02D 29/127 256/65.01
6,799,395 B1 * 10/2004 Dabrowski ..... E02D 29/1418 49/366
6,931,793 B2 * 8/2005 Joyce ..... E04D 13/0315 182/112
7,028,431 B2 * 4/2006 Tlemcani ..... E05F 1/006 292/DIG. 65
7,638,962 B2 * 12/2009 Cardwell ..... E05F 15/79 318/443
8,839,559 B2 * 9/2014 Neff ..... E05F 3/02 49/324
8,844,202 B2 * 9/2014 Carralero ..... E06B 1/52 16/357
9,021,743 B2 * 5/2015 Piermee ..... E02D 29/1418 16/289
9,303,441 B2 * 4/2016 Bravo ..... E05F 1/1058
2010/0031573 A1 * 2/2010 Whiting ..... E05B 47/02 49/31
2010/0326769 A1 * 12/2010 Cuccurullo ..... E04D 13/0335 182/97
2011/0017967 A1 * 1/2011 Whiting ..... E04D 13/0335 256/59
2011/0083376 A1 * 4/2011 Cuccurullo ..... E04D 13/0335 52/20
2011/0232201 A1 * 9/2011 Cardwell ..... E02D 29/12 52/20
2012/0317885 A1 * 12/2012 Royer ..... E05F 1/1091 49/380
2013/0212954 A1 * 8/2013 Taylor ..... E06B 5/10 52/19
2014/0196495 A1 * 7/2014 Marks ..... F24F 13/32 62/426
2015/0027066 A1 * 1/2015 Desmond ..... F24F 13/32 52/27
2015/0101272 A1 * 4/2015 Richmond ..... E04F 11/062 52/183
2015/0315793 A1 * 11/2015 Deutsch ..... E05F 15/00 49/324
2016/0237680 A1 * 8/2016 Xiao ..... E06B 5/01
2018/0266116 A1 * 9/2018 Jorgenson ..... E04D 13/1415
2019/0211561 A1 * 7/2019 Dempster ..... E04D 13/00

* cited by examiner

SYSTEMS FOR WEATHERPROOF ROOF HATCH ASSEMBLIES

BACKGROUND

The present disclosure relates generally to heating, ventilating, and air conditioning (HVAC) systems, and more particularly, to systems for weatherproof roof hatch assemblies for HVAC systems.

Residential, light commercial, commercial, and industrial systems are used to control temperatures and air quality in buildings. To condition the buildings, HVAC systems may circulate a fluid, such as a refrigerant, through a closed loop between an evaporator where the fluid absorbs heat and a condenser where the fluid releases heat. The fluid flowing within the closed loop is generally formulated to undergo phase changes within the normal operating temperatures and pressures of the system so that quantities of heat can be exchanged by virtue of the latent heat of vaporization of the fluid to provide conditioned air to the buildings.

Certain equipment of an HVAC system may be disposed on top of a roof of a building. Thus, to provide access to equipment, the building may be fit with a roof hatch that connects the interior of the building to the roof. However, the roof hatch may not be weatherproof and/or impact resistant in conditions having high winds, thus limiting performance of the HVAC system by enabling unconditioned air or rain to enter the building. Accordingly, it may be desirable to provide roof hatches having a greater weather resistance or structural integrity to allow for more efficient operation of the HVAC system, while also enabling users to access the rooftop from inside of the building.

SUMMARY

In one embodiment of the present disclosure, a roof hatch for enabling access to a rooftop of a building from an interior of the building includes a curb adapter configured to be disposed over a curb of the rooftop. The curb is formed around an opening in the rooftop that fluidly connects the interior of the building to an exterior of the building. The roof hatch includes a cover coupled to the curb adapter by a pivoting member. The cover includes a support extending within an interior length of the cover. Additionally, the roof hatch includes a gas spring coupled between the support and the curb adapter. The gas spring is configured to apply a force to the support, and the support is configured to distribute the force along the interior length of the cover.

In another embodiment of the present disclosure, a roof hatch assembly for enabling access to a rooftop of a building from an interior of the building includes a curb adapter configured to be disposed over a curb of the rooftop. The curb is formed around an opening in the rooftop that fluidly connects the interior of the building to an exterior of the building. The roof hatch assembly also includes a cover coupled to the curb adapter by a pivoting member. The cover includes an inner structure having a support extending within the cover in an edge portion of the cover. Additionally, the roof hatch assembly includes a gas spring laterally positioned within the roof hatch assembly and coupled between the support and the curb adapter, wherein the gas spring is configured to apply an opening force to the edge portion of the cover to assist opening of the cover relative to the curb adapter without deflecting the cover.

In a further embodiment of the present disclosure, a roof hatch assembly for enabling access to a rooftop of a building from an interior of the building includes a curb adapter configured to be disposed over a curb of the rooftop. The curb is formed around an opening in the rooftop that fluidly connects the interior of the building to an exterior of the building. The roof hatch assembly also includes a cover coupled to the curb adapter by a pivoting member. The cover includes an inner structure having a plurality of support extending along a perimeter of the cover and an insulation panel disposed within the perimeter of the cover.

Other features and advantages of the present application will be apparent from the following, more detailed description of the embodiments, taken in conjunction with the accompanying drawings which illustrate, by way of example, the principles of the application.

DRAWINGS

DETAILED DESCRIPTION

The present disclosure is directed to systems for weatherproof roof hatch assemblies for buildings using HVAC systems, such as rooftop units. In general, HVAC systems include multiple components that are designed to condition an interior space of a building, such as a commercial building or residence. In some embodiments, the components may generate audible sounds when conditioning the interior space, and are thus located outside of the building to reduce an amount of the audible sounds that are discernable from the interior space. In certain embodiments, the components are positioned within a rooftop unit located on a rooftop of the building. Thus, to enable users to access the components on the rooftop from an interior of the building, the present embodiments include roof hatch assemblies that provide access to the rooftop via a stairwell, a ladder, or the like within the building.

In the present embodiments, the roof hatch assembly includes two main assemblies: a cover assembly, and a curb assembly. The cover assembly is hingedly coupled to the curb assembly, and the curb assembly is disposed over a curb surrounding an opening within the rooftop. A user may open the roof hatch assembly by pushing the cover assembly open from the interior of the building to access the components of the HVAC system on the rooftop of the building. Additionally, the user may open the roof hatch assembly from the rooftop by pulling an exterior handle to return into the interior of the building. Moreover, to enhance weather resistance of a roof hatch assembly, a gas spring assembly that assists in opening the roof hatch may be coupled to a support structure within the roof hatch assembly. For example, the support structure disposed within the cover assembly enables the gas spring assembly and other attachments of the roof hatch assembly, such as a hold open arm assembly and a locking mechanism, to apply force to the cover assembly without deflecting the cover assembly. The force applied by the spring assembly may therefore be evenly distributed across the cover assembly, thus enabling the cover assembly to seal more evenly with the curb assembly for enhanced weather resistance as compared to roof hatch assemblies that do not include support structures, as discussed in more detail below.

Figure 1:
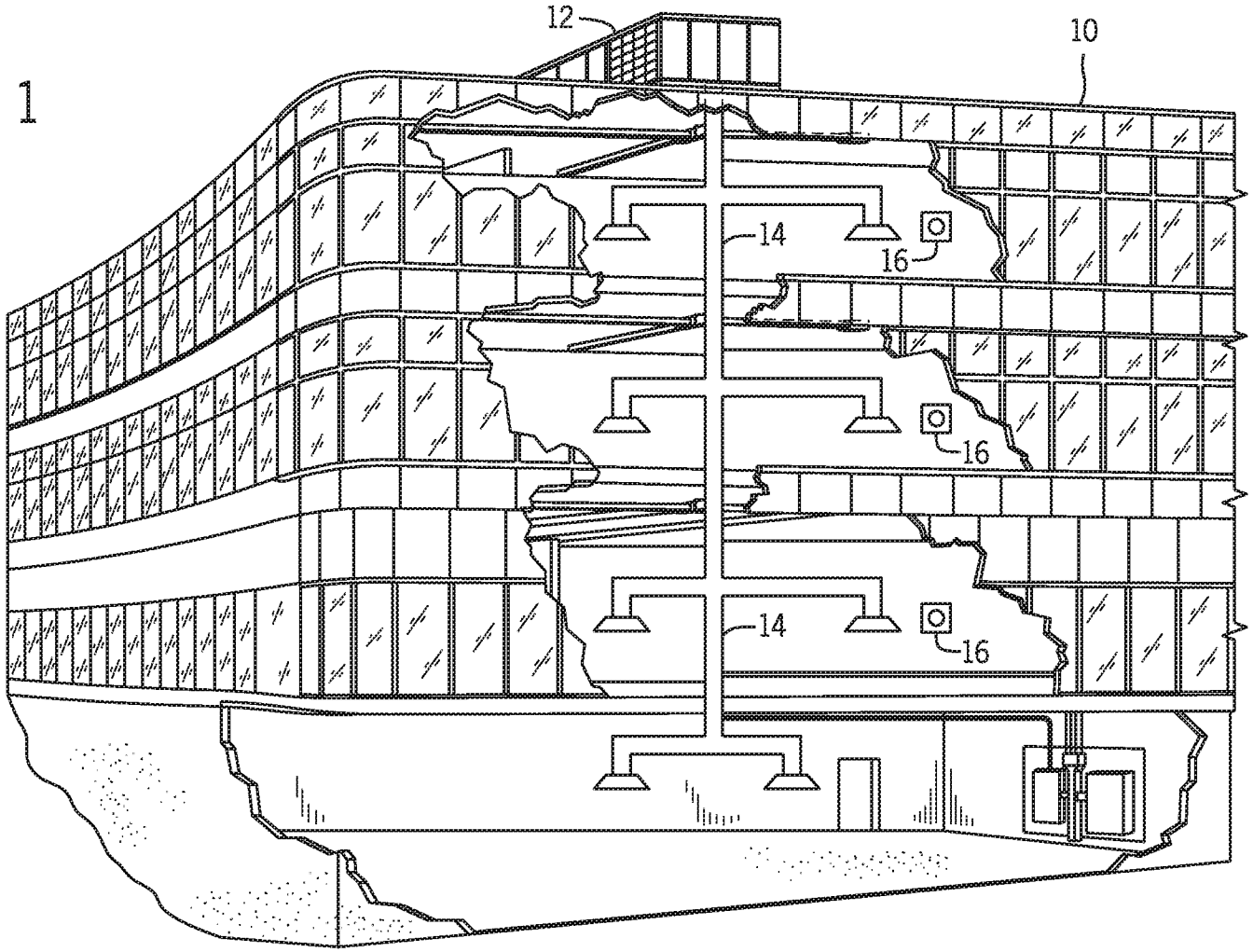
FIG. 1 is an illustration of an embodiment of a building having a commercial or industrial HVAC system, in accordance with the present techniques.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial or a residential building. As shown, the HVAC unit 12 is disposed on the roof of the building 10; however, the HVAC unit 12 may be located in other equipment rooms or areas adjacent the building 10. The HVAC unit 12 may be a single packaged unit containing other equipment, such as a blower, integrated air handler, and/or auxiliary heating unit. In other embodiments, the HVAC unit 12 may be part of a split HVAC system.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It may be desirable to access the HVAC unit 12 on the roof of the building 10 to perform maintenance, installations, and inspections. Thus, to provide access to the HVAC unit 12 on the roof of the building 10 from an interior of the building, present embodiments include a roof hatch assembly that selectively enables user access to the roof. The roof hatch assembly generally includes a curb assembly or curb adapter mounted around an opening formed in the roof and a cover assembly that may be moved relative to the curb assembly. By enabling users to access to the HVAC unit 12 through the roof hatch assembly, the users may more easily and efficiently service the HVAC unit 12. Additionally, the roof hatch assembly includes multiple components that increase a weather resistance and a thermal efficiency of the roof hatch assembly, as discussed in more detail below.

Figure 2:
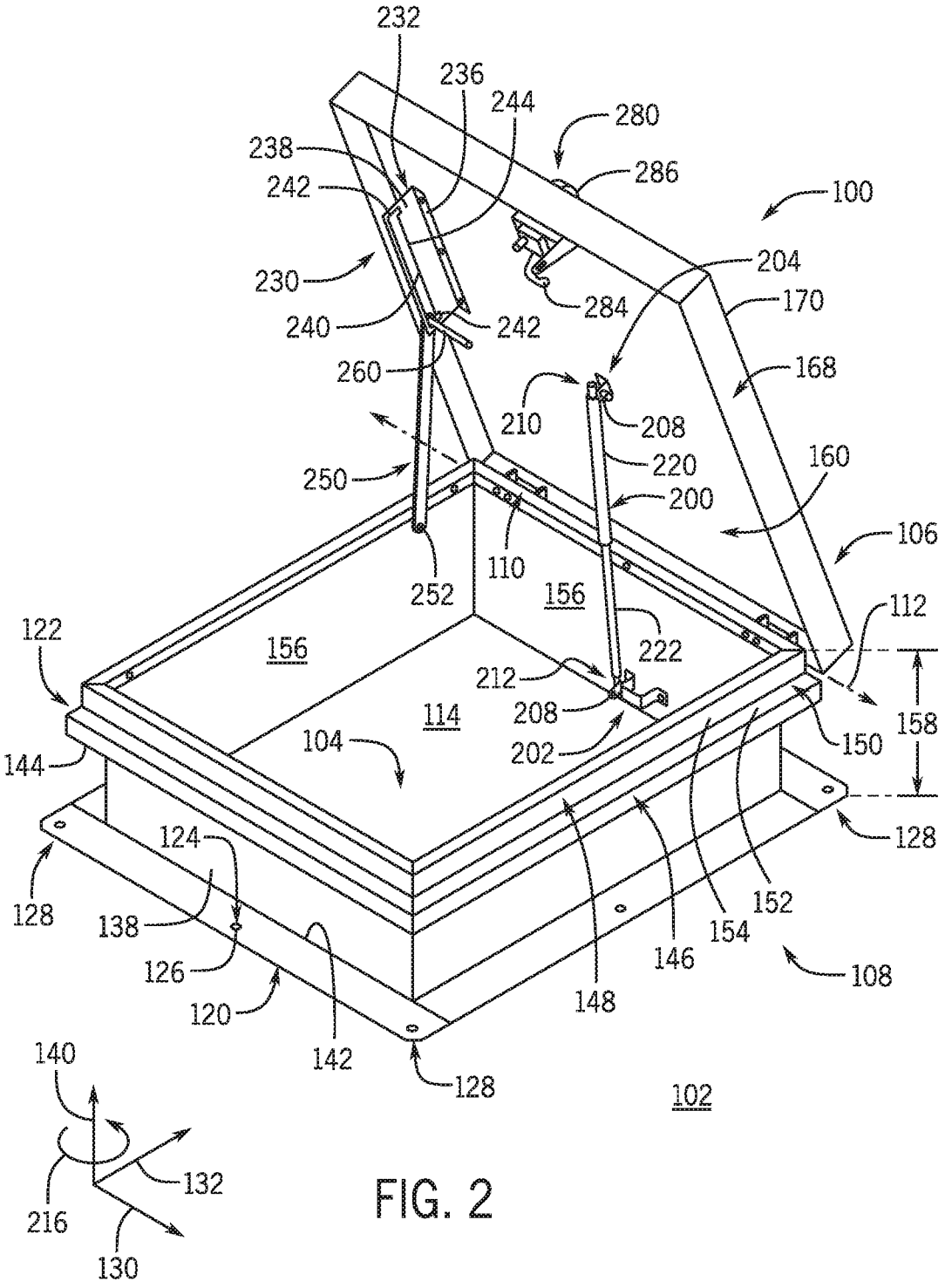
FIG. 2 is a perspective view of an embodiment of a roof hatch assembly of the building of FIG. 1, in accordance with the present techniques.

FIG. 2 is a perspective view illustrating an embodiment of a roof hatch assembly 100 for providing access to a rooftop 102 of a building from an interior 104 of the building. For example, the roof hatch assembly 100 may be any suitable roof hatch or roof hatch assembly disposed on a rooftop 102 of the building 10 discussed above. In certain embodiments, the roof hatch assembly 100 enables user access to HVAC components on the rooftop 102, such as HVAC components within the HVAC unit 12 discussed above. As shown, the roof hatch assembly 100 includes a cover assembly 106 coupled to a curb assembly 108. In the present embodiment, the cover assembly 106 is coupled to the curb assembly 108 via hinges 110 that enable the cover assembly 106 to pivot around an axis 112 relative to the curb assembly 108. However, a different number or placement of hinges, or other suitable rotating, pivoting, or sliding elements may be included according to the techniques discussed herein. Additionally, as discussed below, the cover assembly 106 includes an internal support structure that enables the present placement of components on the roof hatch assembly 100, which improve a weather resistance of the roof hatch assembly 100.

In some embodiments, the curb assembly 108 is disposed over a suitable curb, such as a concrete curb or lip, formed around an opening 114 disposed within the rooftop 102. As such, the curb assembly 108 may be a curb adapter that adapts the roof hatch assembly 100 to the curb. In some embodiments, the curb is a rectangular body having four walls mounted to an exterior surface of the rooftop 102. Additionally, in certain embodiments, the curb is a preexisting curb from a previous roof hatch assembly, and the present roof hatch assembly 100 is installed on or around the preexisting curb. In other embodiments, an opening is formed through a portion of the rooftop 102, the curb is newly formed around the opening in the rooftop 102, and then the present roof hatch assembly 100 is installed thereon.

As illustrated, the curb assembly 108 extends over the curb such that an apron 120 extends from a main body 122 of the curb assembly 108 and along the rooftop 102. Openings 124 may be formed within the apron 120 to enable the curb assembly 108 to be coupled to the rooftop 102 and mounted into place over the curb. For example, as shown, fasteners 126, such as bolts, nails, screws, or the like, are disposed through the openings 124 formed in the apron 120 and into the rooftop 102. As shown, one fastener 126 is disposed through each corner 128 of the apron 120, and another fastener 126 is disposed between each corner 128 of the apron 120 for a total of nine fasteners 126. However, another suitable number of fasteners may be used to couple the apron 120 to the rooftop 102. Thus, by attaching the apron 120 directly to the rooftop 102, the apron 120 is generally flush with the rooftop 102 and extends along an x-y plane defined by an x-axis 130 and a y-axis 132. As such, when the cover assembly 106 is closed, water or other precipitation is physically blocked from travelling from the rooftop 102 into the interior 104 of the building by the curb and the roof hatch assembly 100 assembled thereon. However, the apron 120 may have any suitable form for enabling the curb assembly 108 to be coupled to the curb, including embodiments in which the apron 120 is generally flush with a vertical extent of the curb and is directly coupled to the curb.

Looking to the physical shape of the curb assembly 108, a vertical portion 138 of the curb assembly 108 extends upward along a z-axis 140 from an inner edge 142 of the apron 120. Additionally, attached to or extending from an upper edge 144 of the vertical portion 138, the curb assembly 108 includes an outer horizontal extension 146. The outer horizontal extension 146 protrudes horizontally from the vertical portion 138, such that the outer horizontal extension 146 is generally parallel with the apron 120 and/or the rooftop 102. Moreover, an inner horizontal extension 148 is disposed vertically adjacent to the outer horizontal extension 146, forming an L-shaped receiving space 150 between an upper surface 152 of the outer horizontal extension 146 and an outer surface 154 of the inner horizontal extension 148. The outer horizontal extension 146 extends further from an inner surface 156 of the curb assembly 108 than the inner horizontal extension 148. Additionally, the curb assembly 108 extends upward by a curb assembly height 158 that generally corresponds to a height of the curb over which the curb assembly 108 is disposed. However, in other embodiments, the curb assembly height 158 is greater than the height of the curb, and the curb assembly 108 defines a hollow volume and/or a structurally supported volume above an upper surface of the curb and below an inner surface of the curb assembly 108.

As illustrated, the roof hatch assembly 100 is in an open position. To move to a closed position from the open position, the cover assembly 106 is pivoted along the axis 112 until a liner 160 of the cover assembly 106 contacts the curb assembly 108 and fluidly separates the opening 114 within from an external environment 180 outside of the building. Then, a lip 168 extending vertically downward from an exterior cover cap 170 or exterior cap of the cover assembly 106 is aligned within the L-shaped receiving space 150 of the curb assembly 108, forming a weatherproof seal to fluidly isolate the interior 104 of the building from the external environment 180.

Moreover, to enable efficient operation of the roof hatch assembly 100, the roof hatch assembly 100 includes a plurality of attachments 190 coupled to one or both of the cover assembly 106 and the curb assembly 108. More particularly, the plurality of attachments 190 includes a gas spring assembly 200. In the illustrated embodiment, the gas spring assembly 200 is coupled between two brackets: a gas spring curb bracket 202 attached to the inner surface 156 of the curb assembly 108 and a gas spring cover bracket 204 attached through the liner 160 and to the support structure within the cover assembly 106. As discussed in more detail below, the gas spring cover bracket 204 is fastened to the support structure within the cover assembly 106 to enhance a strength, to enhance a durability, and to reduce deflection of the cover assembly 106. In some embodiments, the gas spring assembly 200 includes ball joints 208 at both of an upper end 210 of the gas spring assembly 200 near the gas spring cover bracket 204, and at a lower end 212 of the gas spring assembly 200 near the gas spring curb bracket 202. The ball joints 208 may enable the gas spring assembly 200 to rotate along a circumferential direction 216 defined around the z-axis 140 to improve mobility of the gas spring assembly 200 during operation. However, the gas spring assembly 200 may be coupled between the cover assembly 106 and the curb assembly 108 by any other suitable attachment features.

Generally, the gas spring assembly 200 operates to store potential energy within a cylinder 220 based on a position of a piston within the cylinder 220. The cylinder 220 may be any suitable pneumatic cylinder for storing potential energy therein. In some embodiments, the piston is disposed at a first end of a piston rod 222, which is movable relative to the cylinder 220 based on a position of the cover assembly 106. For example, as a user moves the cover assembly 106 from the closed position to the open position, the piston rod 222 and piston move further out of the cylinder 220 along its stroke length, elongating the gas spring assembly 200 to provide an opening force to the cover assembly 106. Thus, when the cover assembly 106 is opening, the volume within the cylinder 220 increases, decompressing and lowering a pressure of a gas stored within the gas spring assembly 200 to provide force to assist in opening the cover assembly 106. In this manner, the gas spring assembly 200 may also provide wind and weather resistance to the cover assembly 106, resisting an opening force provided by external conditions that may deflect or otherwise affect the cover assembly 106. Moreover, the stroke length of the gas spring assembly 200 may be adjusted to modify the operation of the gas spring assembly 200 for any suitable arrangement of components of the roof hatch assembly 100.

Moreover, in some embodiments, closing the cover assembly 106 from the depicted open position may move the piston rod 222 and piston further within the cylinder 220, thus compressing and increasing the pressure of the gas stored within the gas spring assembly 200, which stores potential energy for a subsequent opening of the cover assembly 106. Accordingly, the gas spring assembly 200 manipulates the pressure of the gas within the cylinder 220 to provide force to assist in opening the cover assembly 106 and/or regulate a speed of opening the cover assembly 106. The gas spring assembly 200 may be any suitable gas spring assembly, such as a standard cylinder, a fixed-height cylinder, a spindle only, a cable cylinder, a stage cylinder, a non-rotating cylinder, a return cylinder, an auto-return cylinder, a bouncing cylinder, a dual-mode cylinder, or a heavy duty cylinder.

Additionally, the plurality of attachments 190 of the roof hatch assembly 100 includes a hold open arm assembly 230. The hold open arm assembly 230 enables the cover assembly 106 to be maintained within the open position and/or opened from the interior 104 of the building. As shown, a receiving bracket 232 of the hold open arm assembly 230 is coupled through the liner 160 and into the support structure within the cover assembly 106. In some embodiments, the receiving bracket 232 is a sheet of metal which includes a secured surface 236 coupled to the liner 160, and a hanging surface 238 extending from the secured surface 236. Indeed, as discussed in more detail below, the secured surface 236 is fastened to the support structure within the cover assembly 106 to enhance the strength and reduce deflection of the cover assembly 106. Additionally, a slot 240 extends within the hanging surface 238 and has two distal slot portions 242 of a greater height than a height of a central span 244 of the slot 240. A hold open arm 250 or arm extension is coupled to the inner surface 156 of the curb assembly 108 via a fastener 252, such as a shoulder bolt. The hold open arm 250 also includes a handle 260 that extends within the slot 240 of the receiving bracket 232. By moving the handle 260 within the slot 240, a user can move the cover assembly 106 between the open position and the closed position. Additionally, by positioning the handle 260 within a distal slot portion 242, the user may block sliding motion of the handle 260 within the central span 244 of the slot 240 to employ the hold open arm assembly 230 to maintain the cover assembly 106 in the open position.

The roof hatch assembly 100 further includes a locking mechanism 280 for enabling the cover assembly 106 to be locked in place in the closed position. As shown, the locking mechanism 280 includes a latch 284 that extends downward from the cover assembly 106. The locking mechanism 280 also includes an exterior handle 286 to open the cover assembly 106 from the rooftop 102. In some embodiments, the locking mechanism 280 locks the cover assembly 106 in the closed position by positioning the latch 284 within a latch catch of the curb assembly 108. However, in other embodiments, the roof hatch assembly 100 alternatively includes a suitable opening or recess for receiving the latch 284 therein. Thus, based on user adjustment of the exterior handle 286, the locking mechanism 280 may adjust the position of the latch 284 between a closed latch position that blocks the user from opening the cover assembly 106 and an open latch position that enables the user to open the cover assembly 106. The locking mechanism 280 is also coupled through to the support structure within the cover assembly 106 to enhance the strength and reduce deflection of the cover assembly 106. Indeed, the cover assembly 106 includes interior structural supports to provide rigid and durable footholds for the plurality of attachments 190 coupled thereto. Additional details related to a portion of the plurality of attachments 190 coupled to the curb assembly 108 and additional details related to the cover assembly 106 will be discussed respectively with reference to FIGS. 3-8 below.

Figure 3:
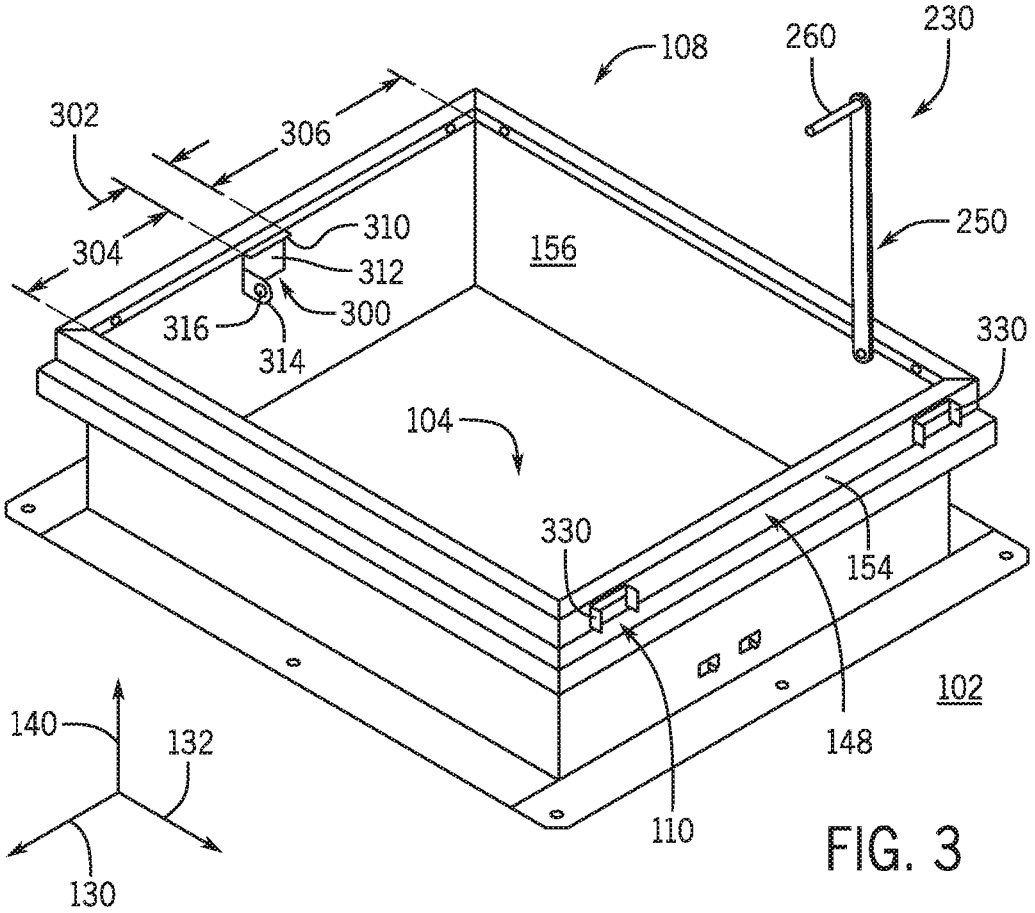
FIG. 3 is a perspective view of an embodiment of a curb assembly of the roof hatch assembly of FIG. 2, in accordance with the present techniques.

FIG. 3 is a perspective view of an embodiment of the curb assembly 108 of the roof hatch assembly 100 from another perspective than the perspective of FIG. 2. As shown in the illustrated embodiment, the cover assembly 106 is not attached to the curb assembly 108. Moreover, a latch catch 300 for receiving the latch 284 of the locking mechanism 280 is shown attached to the inner surface 156 of the curb assembly 108. In some embodiments, the latch catch 300 is welded to the inner surface 156 in a central curb portion 302 of the curb assembly 108, such that a first adjacent span 304 defined on a first side of the central curb portion 302 is approximately equal to a second adjacent span 306 defined on a second side of the central curb portion 302. The latch catch 300 also includes an upper flange 310 extending from a secured portion 312 of the latch catch 300 in the x-y plane formed between the x-axis 130 and the y-axis 132, and a distal flange 314 extending from the secured portion 312 in a y-z plane formed between the y-axis 132 and the z-axis 140. The cover assembly 106 may rest on the upper flange 310 when in the closed position, thus supporting and distributing a weight of the cover assembly 106 and/or providing an alignment feature that reduces or eliminates bending of the cover assembly 106. In the illustrated embodiment, a distal flange opening 316 extends through the distal flange 314 for receiving an extension or locking feature of the locking mechanism 280 and/or the latch 284 therethrough.

Additionally, curb hinge portions 330, such as U-brackets, of the hinges 110 are coupled to the outer surface 154 of the inner horizontal extension 148 of the curb assembly 108. Corresponding cover hinge portions of the hinges 110 may be coupled to the cover assembly 106, and also coupled to the curb hinge portion 330 to provide the axis 112 of rotation around which the cover assembly 106 rotates during operation. The hold open arm 250 of the hold open arm assembly 230 is also shown coupled to the inner surface 156 of the curb assembly 108. Thus, the embodied attachments 190 are coupled to the curb assembly 108 during construction of the roof hatch assembly 100 to enable the cover assembly 106 to be operatively attached to the curb assembly 108. Then, users are able to access the rooftop 102 from the interior 104 of the building by moving the cover assembly 106 to the open position relative to the curb assembly 108.

Figure 4:
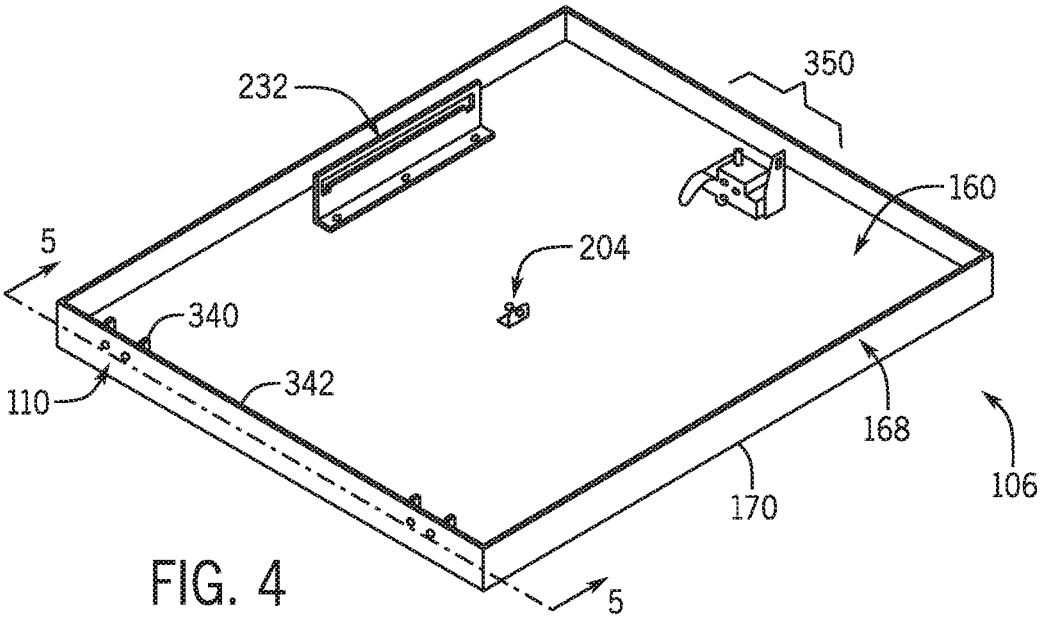
FIG. 4 is a perspective view of an embodiment of a cover assembly of the roof hatch assembly of FIG. 2, in accordance with the present techniques.

Looking now to additional embodiments of the cover assembly 106, FIG. 4 is a schematic diagram of an embodiment of the cover assembly 106 of the roof hatch assembly 100. The illustrated embodiment of the cover assembly 106 includes cover hinge portions 340 coupled to an inner surface 342 of the lip 168 of the cover assembly 106. The cover hinge portions 340 are capable of being coupled to the curb hinge portions 330 to form the hinges 110. Additionally, the cover assembly 106 includes the receiving bracket 232 of the hold open arm assembly 230, the gas spring cover bracket 204 of the gas spring assembly 200, and the locking mechanism 280 discussed above with reference to FIG. 2. In the present embodiment, the plurality of attachments 190 is coupled through the liner 160 to the support structure within the cover assembly 106. The support structure thus provides structural integrity to the roof hatch assembly 100 that enables the gas spring assembly 200 to be attached to a central cover portion 350 of the cover assembly 106 to provide opening force without deflecting the cover assembly 106. The cover assembly 106 thus includes a three layer construction or sandwiched construction that sequentially includes an exterior cover cap 170, the support structure, and the liner 160.

Figure 5:
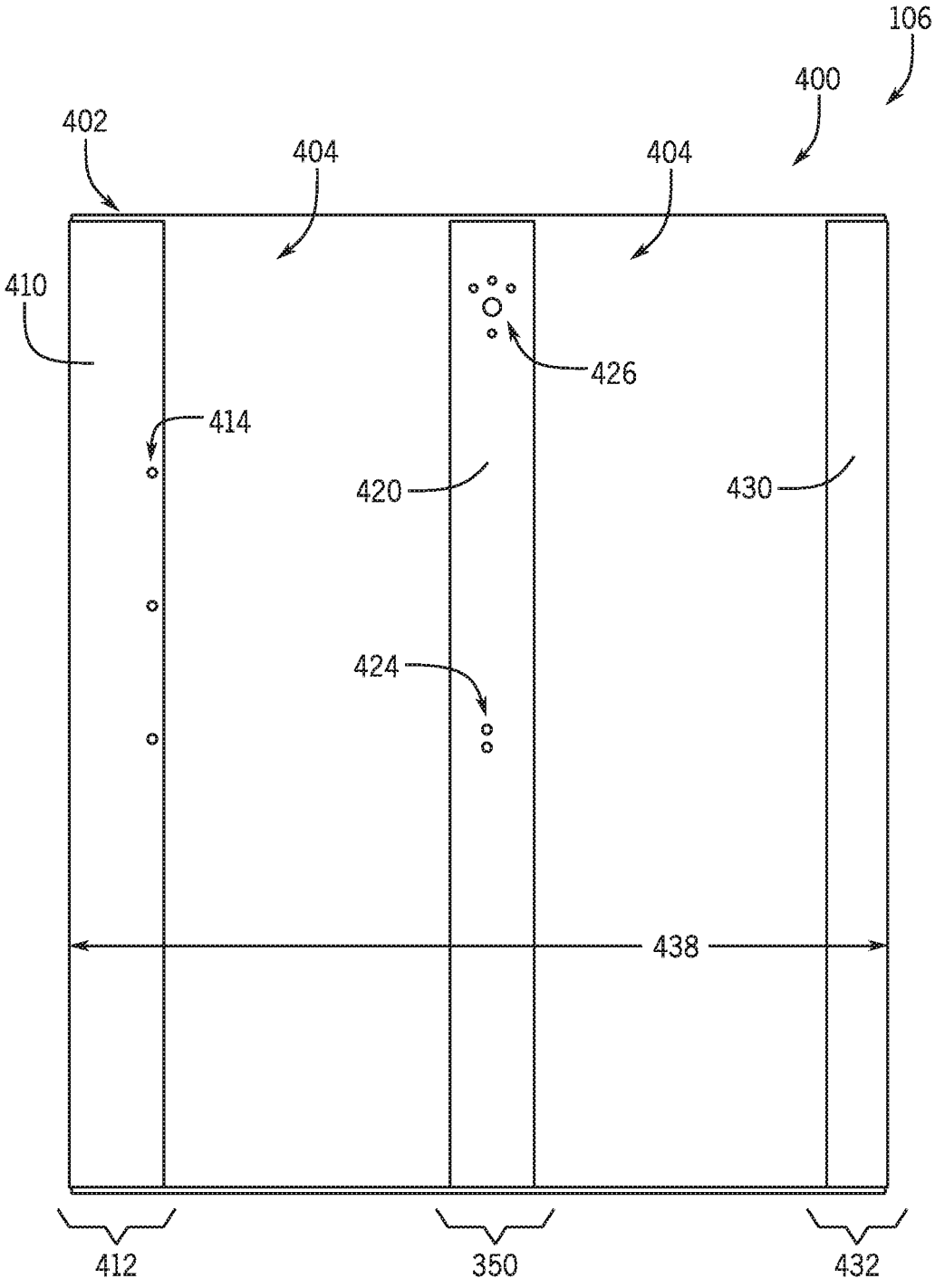
FIG. 5 is a cross sectional view of an embodiment of a support structure within the roof hatch assembly shown in FIG. 4, taken along line 5-5, in accordance with the present techniques.

Looking along the 5-5 line of FIG. 4, FIG. 5 is a cross sectional view of the cover assembly 106, including a support structure 400 disposed therein. In the present embodiment, the support structure 400 includes one or more support elements 402 disposed adjacent to insulation panels 404. For example, a textured outer support element 410 is disposed within a first outer portion 412 of the cover assembly 106, a textured inner support element 420 is disposed within the central cover portion 350, and a smooth outer support element 430 is disposed within a second outer portion 432 of the cover assembly 106. Additionally, as seen in the present embodiment, one insulation panel 404 is disposed within a receiving space between the textured outer support element 410 and the textured inner support element 420, and another insulation panel 404 is disposed within another receiving space between the textured inner support element 420 and the smooth outer support element 430. In other embodiments, any suitable number of insulation panels 404 may be disposed between any respectively suitable number of support elements 402. In some embodiments, the insulation panels 404 may also be excluded from the cover assembly 106, such that the cover assembly 106 includes one or more hollow volumes therein.

To assemble the support structure 400, the support structure 400 may be welded to an interior surface of the exterior cover cap 170, and the liner 160 may then be coupled in place over the support structure 400 to form the cover assembly 106. Then, the attachments 190 may be affixed to the cover assembly 106 through the liner 160 and into the support structure 400. To enhance an ease of assembling the cover assembly 106, the textured outer support element 410 includes receiving bracket apertures 414, such as weld nuts, for receiving fasteners that attach the receiving bracket 232 to the cover assembly 106. The textured inner support element 420 also includes cover bracket apertures 424 for receiving fasteners that attach the gas spring cover bracket 204 of the gas spring assembly 200 to the cover assembly 106. Additionally, the textured inner support element 420 includes locking mechanism apertures 426 for receiving and securing the locking mechanism 280 through the cover assembly 106.

The support structure 400 provides several benefits to the present embodiments. For example, by using the support structure 400 within the cover assembly 106, components of the roof hatch assembly 100 may be anchored or attached to rigid and durable support elements as opposed to being superficially or marginally attached to a surface of the cover assembly 106. Consequently, the hold open arm assembly 230 may distribute a force that maintains the cover assembly 106 in the open position across the textured outer support element 410, thus reducing or eliminating deflection of the cover assembly 106. Similarly, a stronger gas spring assembly 200 may be selected to apply a stronger opening force to the cover assembly 106 without deflecting or bending the cover assembly 106, as compared to traditional roof hatch assemblies without a support structure. Then, by assembling the gas spring assembly 200 in the central cover portion 350, the gas spring assembly 200 is capable of applying the force evenly across a width 438 or interior length of the cover assembly 106, improving a weather resistance of the roof hatch assembly 100 compared to traditional roof hatch assemblies having the gas spring assembly 200 located in an end portion of a width of a cover portion and uncoupled to an inner support structure. Additionally, by employing the support elements 402 instead of a flat and/or solid sheet of metal, the cover assembly 106 may be lighter and easier to open, while also using less material than embodiments having the flat and/or solid sheet of metal.

Figure 6:
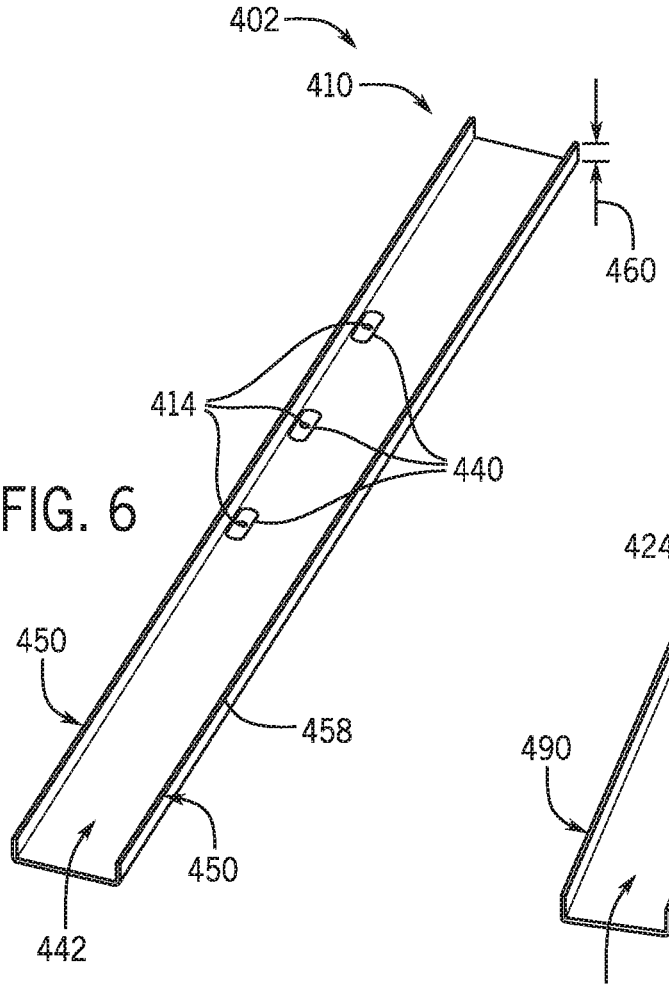
FIG. 6 is a perspective view of an embodiment of a textured outer support element of the support structure shown in FIG. 4, in accordance with the present techniques.

FIG. 6 is a perspective view of an embodiment of the textured outer support element 410 of the support structure 400. As shown, the textured outer support element 410 includes the receiving bracket apertures 414 for enabling the receiving bracket 232 to be coupled therethrough. Additionally, the present embodiment of the receiving bracket apertures 414 are formed within weld nuts 440 that are welded to a base portion 442 of the textured outer support element 410. The weld nuts 440 may include a nut portion that includes threads for receiving a mating bolt, and a base portion that includes metal or another suitable material that is welded to the textured outer support element 410. However, in other embodiments, other suitable elements for receiving fasteners may be employed, such as rib nuts, rivet nuts, threaded inserts, openings, and so forth. Moreover, two elongated flange portions 450 extend upward from the base portion 442 of the textured outer support element 410 to form a U-shaped cross section of the textured outer support element 410. Then, when constructing the cover assembly 106, an outer edge portion 458 of each elongated flange portion 450 may be welded to the interior surface of the exterior cover cap 170. Thus, a height 460 of each elongated flange portion 450 defines a height of the textured outer support element 410, and thus also defines a portion of a height of the cover assembly 106. Additionally, the insulation panels 404 and the other support elements 402 may be formed to have the same height 460 as the textured outer support element 410 to provide a uniform thickness to the support structure 400, as discussed in more detail with reference to FIGS. 7 and 8 below.

Figure 7:
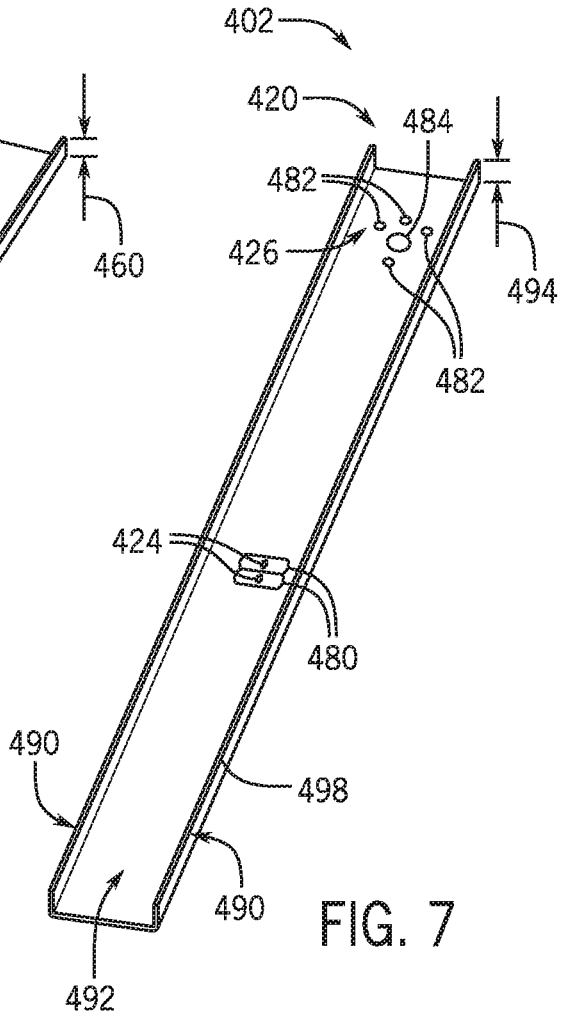
FIG. 7 is a perspective view of an embodiment of a textured inner support element of the support structure shown in FIG. 4, in accordance with the present techniques.

FIG. 7 is a perspective view of an embodiment of a textured inner support element 420 of the support structure 400. As shown, the textured inner support element includes the cover bracket apertures 424 for receiving fasteners that attach the gas spring cover bracket 204 of the gas spring assembly 200 to the cover assembly 106. The cover bracket apertures 424 may be formed within weld nuts 480 may be similar to the weld nuts 440 discussed above with reference to the textured outer support element 410. Additionally, the textured inner support element 420 includes locking mechanism apertures 426 for receiving and securing the locking mechanism 280. In some embodiments, as shown, the locking mechanism apertures 426 include peripheral mounting holes 482 for receiving fasteners that secure a main body of the locking mechanism 280 on the cover assembly 106, and a handle opening 484 for enabling the exterior handle 286 to protrude from the main body of the locking mechanism 280 and out through the exterior cover cap 170. The textured inner support element 420 also includes elongated flange portions 490 that extend from a base portion 492 that form a U-shaped cross section having a height 494 that corresponds to the height 460 of the textured outer support element 410. An outer edge portion 498 of each elongated flange portion 490 may be welded to the inner surface of the exterior cover cap 170.

Figure 8:
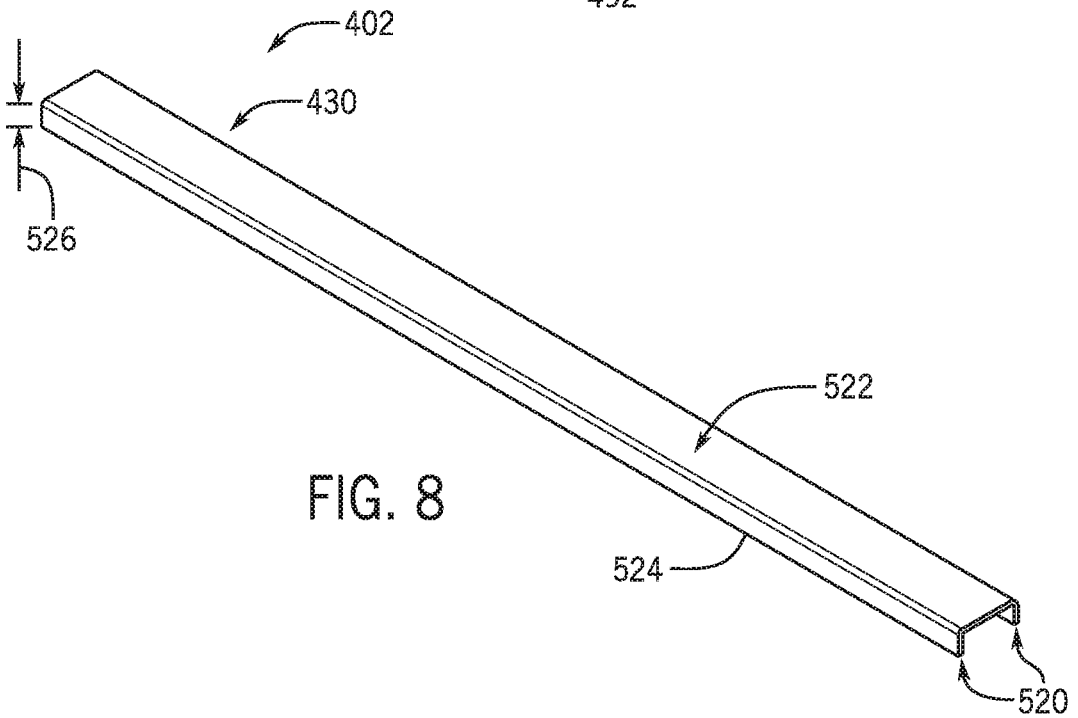
FIG. 8 is a perspective view of an embodiment of a smooth outer support element of the support structure shown in FIG. 5, in accordance with the present techniques.

FIG. 8 is a perspective view of an embodiment of the smooth outer support element 430 of the support structure 400. The illustrated embodiment of the smooth outer support element 430 includes a U-shaped cross section formed by elongated flange portions 520 extending from a base portion 522. An outer edge portion 524 of each elongated flange portion 520 may be coupled to the inner surface of the exterior cover cap 170. Moreover, a height 526 of the smooth outer support element 430 corresponds to the height 460 of the textured outer support element 410 and the height 494 of the textured inner support element 420. Additionally, although no weld nuts or other receiving portions are shown on the smooth outer support element 430, it is to be understood that any suitable attachments 190, such as an additional hold open arm assembly or the like, may be coupled thereto. The smooth outer support element 430 provides structural integrity to the cover assembly 106, and may receive and distribute forces applied to the smooth outer support element 430 from the other support elements 402 of the support structure 400.

Figure 9:
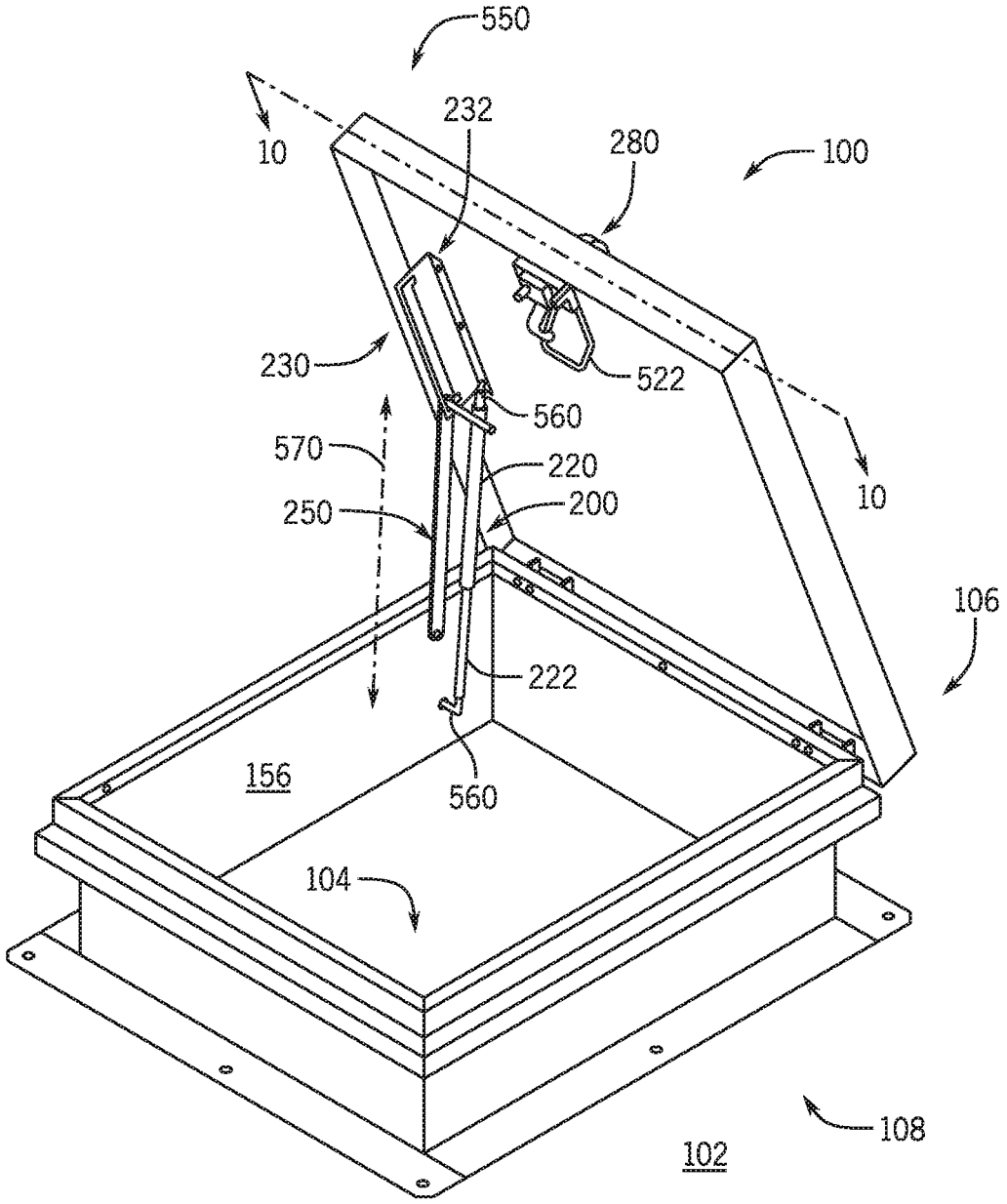
FIG. 9 is a perspective view of an embodiment of a roof hatch assembly, in accordance with the present techniques.

Although the above discussion includes embodiments in which three generally parallel support elements extend along a common direction within the cover assembly 106, it is to be understood that other suitable embodiments of the inner support structure are contemplated herein. By way of example, FIG. 9 is a perspective view illustrating another embodiment of the roof hatch assembly 100 for providing access to the rooftop 102 of the building 10 from the interior 104 of the building 10. The embodiment of the roof hatch assembly 100 of FIG. 9 may include generally similar attachments as the roof hatch assembly 100 of FIG. 2 that enable the user to operate the roof hatch assembly 100. For example, the illustrated roof hatch assembly 100 includes the cover assembly 106 coupled to the curb assembly 108. Additionally, the locking mechanism 280 is attached through the cover assembly 106, and the hold open arm assembly 230 is attached between the cover assembly 106 and the curb assembly 108 at a proximal portion 550 or edge portion of the roof hatch assembly 100. In some embodiments, the locking mechanism 280 also includes a pull handle 552 for enabling the user to easily pull the roof hatch assembly 100 closed. As discussed in more detail below, the cover assembly 106 includes an internal support structure that supports a perimeter of the cover assembly 106 to enable the gas spring assembly 200 to be mounted in close proximity to the hold open arm assembly 230, while also reducing deflection of the cover assembly 106, as illustrated.

As shown, the cylinder 220 of the gas spring assembly 200 is mounted on a ball stud 560 extending from the receiving bracket 232. Additionally, the piston rod 222 of the gas spring assembly 200 is mounted on a ball stud 562 disposed on the inner surface 156 of the curb assembly 108 having the hold open arm 250 mounted thereon. In some embodiments, the gas spring assembly 200 and the hold open arm 250 are generally coextensive along a common axis 570 as shown, though any placement of the gas spring assembly 200 near the hold open arm assembly 230 in which the gas spring assembly 200 and the hold open arm assembly 230 do not interfere with operation of one another is also contemplated herein. By positioning the gas spring assembly 200 in the proximal portion 550 of the roof hatch assembly 100, a length of the gas spring assembly 200 may be reduced or minimized to reduce a moment arm against which the user pulls or pushes to open or close the roof hatch assembly 100. Further, by including the inner support structure within the cover assembly 106, force applied to the cover assembly 106 by the gas spring assembly 200 and/or the hold open arm assembly 230 through the receiving bracket 232 is more evenly distributed throughout the cover assembly 106, such that the inner support structure prevents or reduces twisting of the cover assembly 106 to improve a weather resistance of the roof hatch assembly 100.

Figure 10:
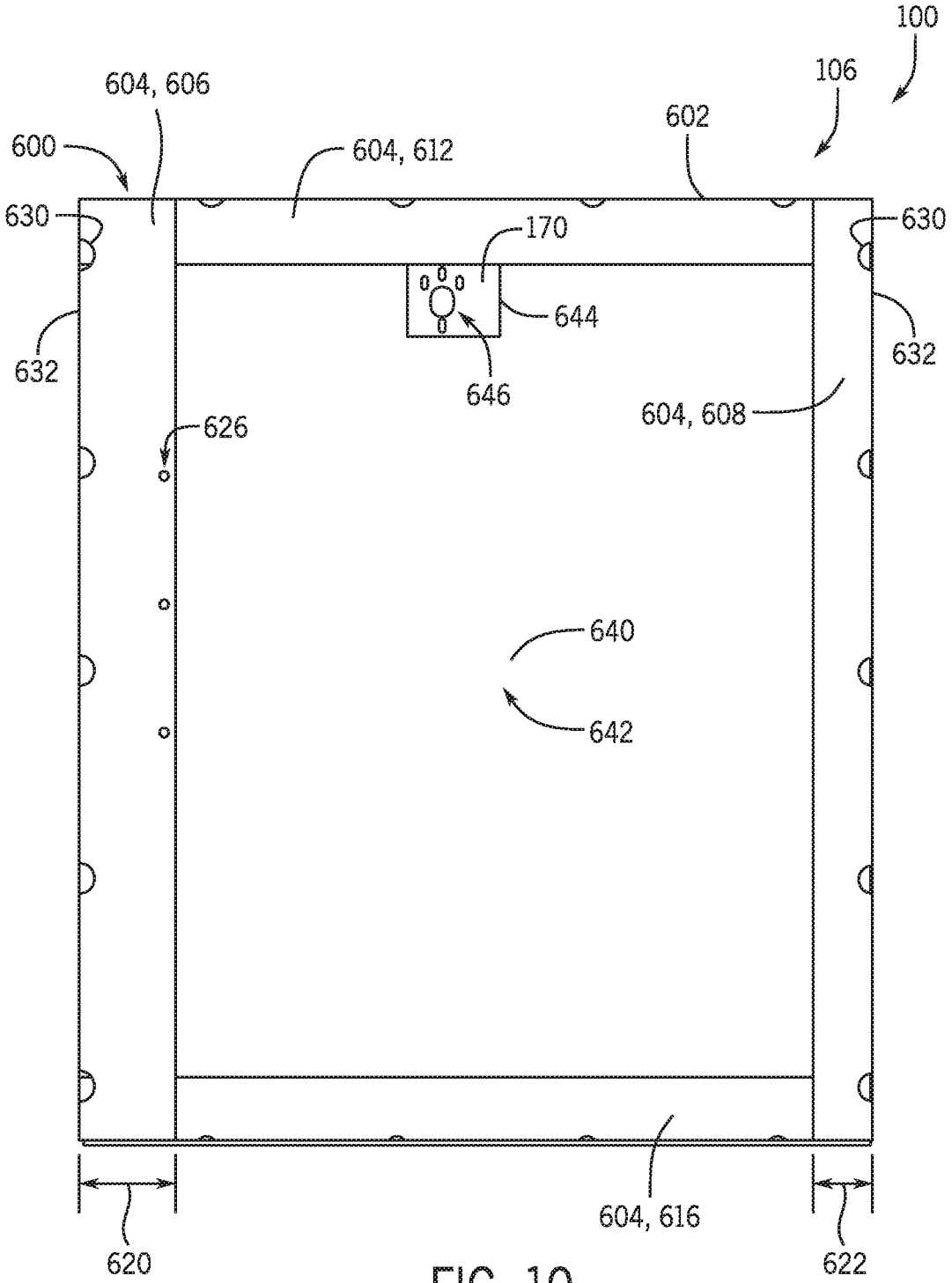
FIG. 10 is a cross sectional view of an embodiment of a support structure within the roof hatch assembly shown in FIG. 9, taken along line 10-10, in accordance with the present techniques.

FIG. 10 is a cross sectional view of an embodiment of a support structure 600 within the cover assembly 106 of the roof hatch assembly 100. By coupling through the liner 160 and into the support structure 600, the receiving bracket 232, the locking assembly 280, and any other suitable features of the roof hatch assembly 100 may operate without twisting or deflecting the cover assembly 106. As shown, the support structure 600 includes multiple support elements that define a perimeter 602 of the cover assembly 106. For example, in the illustrated embodiment, the perimeter 602 is rectangular, and four support elements 604 are arranged along the perimeter 602 between the exterior cover cap 170 and the liner 160 of the cover assembly 106. As such, each support elements 604 may distribute received forces across one or more corresponding sides or interior lengths of the perimeter 602.

More particularly, a wide support element 606 extends within the cover assembly 106 in the proximate portion 550 of the cover assembly 106, and a narrow support element 608 extends within the cover assembly 106 in a distal portion 610, opposite of the proximate portion 550. An upper support element 612 extends between upper portions 614 of the wide support element 606 and the narrow support element 608, and a lower support element 616 extends between lower portions 618 of the wide support element 606 and the narrow support element 608. In the illustrated embodiment, the wide support element 606 includes a greater width 620 than a width 622 of the narrow support element 608 to more effectively distribute forces applied to the wide support element 606 via the receiving bracket 232 within various interior lengths of the cover assembly 120. Additionally, the wide support element 606 includes receiving bracket apertures 626 extending within the wide support element 606 for enabling the receiving bracket 232 to more easily couple to the support structure 600. Further, as illustrated, each support element 604 includes weld recesses 630 defined within an outer edge 632 of each support element 604. By welding the support elements 604 to the exterior cover cap 170 in the weld recesses 630, the support structure 600 may have a smooth or flush lower surface for receiving the cover liner 160. As such, the cover liner 160 is not raised by weld material used to couple the support elements 604 within the cover assembly 106. The weld recesses 630 may be suitably spaced and sized according to a target quantity and a target size of welds for maintaining the support elements 604 within the cover assembly 106.

Moreover, an insulation panel 640 is disposed within a center portion 642 of the cover assembly 106 to increase a thermal and/or noise insulation of the cover assembly 106. By supporting the cover assembly 106 along the perimeter 602 of the cover assembly 106, the support structure 600 enables the insulation panel 640 to be disposed within the cover assembly 106 in a single piece, thus reducing a complexity of the cover assembly 106. In the present embodiment, the insulation panel 640 includes a cutout portion 644. Thus, when the insulation panel 640 is disposed within the exterior cover cap 170 of the cover assembly 106, suitable locking mechanism apertures 646 defined within the exterior cover cap 170 are uncovered for later attachment of the locking mechanism 280. In some embodiments, a suitable support plate is fitted within the cutout portion 644 of the insulation panel 640 to provide additional structural support to the locking mechanism 280.

Figure 11:
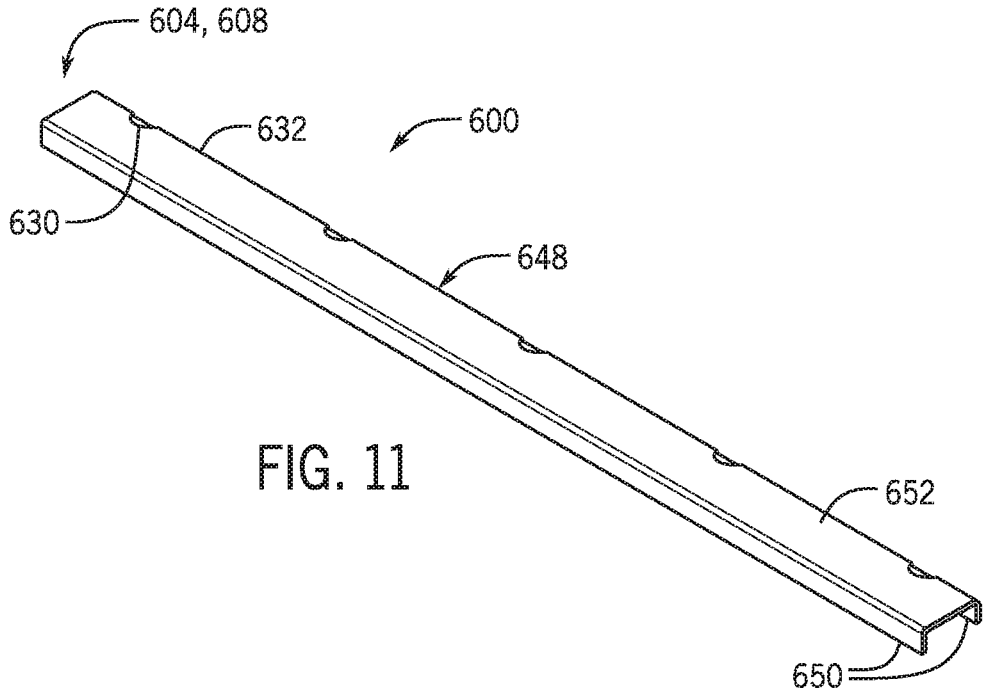
FIG. 11 is a perspective view of an embodiment of a narrow support element of the support structure shown in FIG. 10, in accordance with the present techniques.

FIG. 11 is a perspective view of an embodiment of the narrow support element 608 of the support structure 600. As shown, the narrow support element 608 defines five weld recesses 630 along the outer edge 632 of the narrow support element 608. As shown, the narrow support element 608 defines the weld recesses 630 in a joint portion 648 between an elongated flange portion 650 and a main portion of the narrow support element 608. As such, the weld recesses 630 defined in the narrow support element 608 may be partially or wholly filled via welding material or any other suitable attachment feature to couple the narrow support element 608 to an inner surface of the exterior cover cap 170 during construction of the cover assembly 160. The other support elements 604 may also define suitable weld recesses 630 therein, as discussed above.

Figure 12:
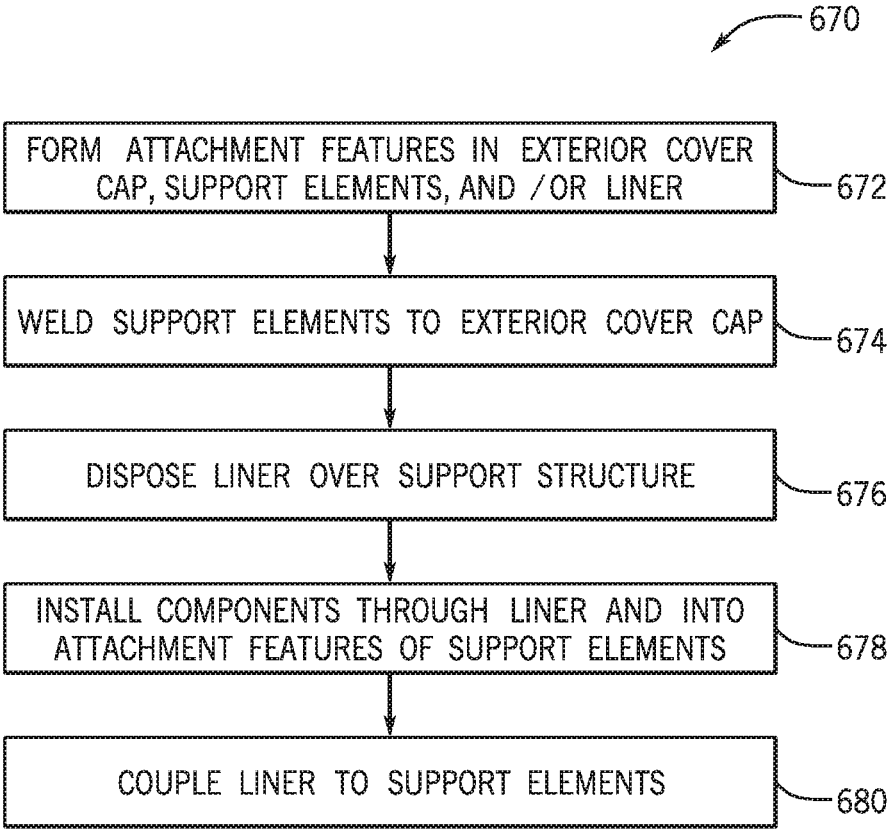
FIG. 12 is a flow chart of an embodiment of a method for forming the cover assembly of the roof hatch assembly, in accordance with the present techniques.

FIG. 12 is a flow chart of an embodiment of a method 670 for forming the cover assembly 106 of the roof hatch assembly 100. One or more steps of the method 670 may be performed simultaneously or in a different sequence from the sequence in FIG. 12. Additionally, the method 670 of FIG. 12 is described with reference to the elements of FIGS. 1-11. The method 670 may be performed by a service technician and/or by automated machinery, or any other suitable actors. First, as indicated by block 672, the method 670 includes forming attachment features in the exterior cover cap 170, the support elements 402, 604, and/or the liner 160. For example, as discussed above, the weld nuts 440 may be welded to the textured outer support element 410, the weld nuts 480 may be welded on the textured inner support element 420, and the peripheral mounting holes 482 and the handle opening 484 may be cut through the textured inner support element 420. In some embodiments, the elongated flange portions 450, 490, 520 of each support element 402 may also be formed at this step of the construction process. In some embodiments, the weld recesses 630 are cut or otherwise formed within the support elements 402, 604 at this step as well. Additionally, respective handle openings may also be cut into the exterior cover cap 170 and the liner 160 to enable the exterior handle 286 to extend completely through the cover assembly 106. Moreover, in some embodiments, corresponding openings may be cut through the liner 160 to enable fasteners to easily protrude through the liner 160 and into the weld nuts 440, 480 of the support structure 400.

Additionally, the method 670 may include welding the support elements 402, 604 to the exterior cover cap 170, as indicated by block 674. Indeed, as discussed above, the respective outer edge portions 458, 498, 524 of each support element 402 may be welded to the interior surface of the exterior cover cap 170, such that an open side of the U-shaped cross section of each support element 402 is closed against the exterior cover cap 170. In embodiments in which the support elements 402, 604 include weld recesses 630, the support elements 402, 604 are welded within the weld recesses 630 to enable the liner 160 to rest evenly across the support structure 400, 600. The insulation panels 404, 640 may optionally be disposed between the support elements 402, 604 at this step of the construction process as well.

The method 670 further includes disposing the liner 160 over the support structure 400, 600, as indicated by block 676. Any attachment features in the liner 160 may be aligned with the corresponding attachment features, such as weld nuts, in the support elements 402, 604. Then, the method 670 includes installing components such as the receiving bracket 232, the locking mechanism 280, and/or the gas spring cover bracket 204 through the liner 160 and into the attachment features of the support elements 402, 604, as indicated by block 678. Additionally, the method 670 includes fastening the liner 160 into the support elements 402, 604, such as by using self-tapping screws or other suitable fasteners, as indicated by block 680. However, in some embodiments, additional openings and/or weld nuts may be included within the liner 160 and the support structure 400, 600 for enabling the liner 160 to be coupled directly into the support elements 402, 604 of the support structure 400, 600. Thus, the cover assembly 106 is formed which includes the enhanced support structure 400, 600 therein to improve a strength and a weather resistance of the roof hatch assembly 100.

Accordingly, the present disclosure is directed to a roof hatch assembly having a cover assembly hingedly coupled to the curb assembly for providing user access to a rooftop of a building from the interior of the building. The cover assembly includes the support structure disposed therein to enable attachments of the roof hatch assembly to distribute forces efficiently and elastically through the support structure. For example, the cover assembly may include an inner support element disposed in a center portion of the cover assembly, outer support elements disposed in end portions of the cover assembly, and insulation panels disposed between adjacent support elements. Thus, the gas spring assembly may be located in the center portion of the cover assembly to evenly apply opening force to the cover assembly during operation, without deflecting or otherwise wearing the cover assembly. Further, in some embodiments, the support elements may surround a perimeter inside the cover assembly to enable the gas spring assembly to couple through a support element disposed in an edge portion of the cover assembly. Additional attachments, such as the locking mechanism and the hold open arm assembly, are also beneficially coupled to the support elements to improve their operability. As such, the present embodiments of the roof hatch assembly may use stronger gas spring assemblies, hold open arm assemblies, and/or locking mechanisms to provide an easily operated and weatherproof selective opening between the interior of the building and its rooftop.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A roof hatch for enabling access to a rooftop of a building from an interior of the building, comprising:

a curb assembly configured to be disposed over a curb of the rooftop, wherein the curb is formed around an opening in the rooftop that fluidly connects the interior of the building to an exterior of the building;

a cover coupled to the curb assembly by a pivoting member, wherein the cover comprises a liner and a support extending within an interior length of the cover; and a gas spring coupled through the liner between the support and the curb assembly, wherein the gas spring is configured to apply a force to the support, and wherein the support is configured to distribute the force along the interior length of the cover.

2. The roof hatch of claim 1, wherein the cover further comprises an exterior cap configured to be exposed to an external environment, an inner structure coupled to an interior surface of the exterior cap, and the liner coupled to a lower surface of the inner structure.

3. The roof hatch of claim 2, wherein the inner structure comprises a plurality of supports comprising the support, and wherein the plurality of supports extends along a perimeter of the cover.

4. The roof hatch of claim 1, wherein the support extends within a center portion of the cover.

5. The roof hatch of claim 1, wherein the support comprises a U-shaped cross section formed by elongated flange portions that extend away from a main portion of the support.

6. The roof hatch of claim 5, wherein edge portions of the elongated flange portions of the support are coupled to an interior surface of an exterior cap that comprises an outermost layer of the cover.

7. The roof hatch of claim 6, wherein the gas spring is configured to apply an opening force to the support to assist opening of the cover relative to the curb assembly without deflecting the exterior cap.

8. The roof hatch of claim 6, wherein the support comprises weld recesses in a joint portion between the edge portions of the elongated flange portion and the main portion of the support, and wherein the weld recesses are configured to receive weld material.

9. The roof hatch of claim 1, comprising a hold open arm coupled between the support and the curb assembly, wherein the hold open arm comprises a receiving bracket coupled through the liner to the support, and wherein the gas spring is coupled to the receiving bracket.

10. The roof hatch of claim 9, wherein the hold open arm is configured to enable the roof hatch to be opened to an open position from the interior of the building, and is configured to enable the roof hatch to maintain the open position.

11. The roof hatch of claim 1, wherein the support comprises a first support, wherein the cover further comprises a second support, and wherein the roof hatch comprises a hold open arm coupled through the liner between the second support and the curb assembly.

12. The roof hatch of claim 1, wherein the support comprises a first support, wherein the cover further comprises a second support, and wherein the cover comprises an insulation panel disposed within the cover between the first support and the second support.

13. The roof hatch of claim 1, comprising a locking mechanism disposed through the cover and the liner to enable the roof hatch to be opened to an open position from the rooftop of the building.

14. The roof hatch of claim 13, wherein the locking mechanism comprises an exterior handle configured to open the cover from the rooftop of the building, and wherein the gas spring is configured to provide an opening force to the cover when the exterior handle is used to open the roof hatch.

15. A roof hatch assembly for enabling access to a rooftop of a building from an interior of the building, comprising:

a curb assembly configured to be disposed over a curb of the rooftop, wherein the curb is formed around an opening in the rooftop that fluidly connects the interior of the building to an exterior of the building;

a cover coupled to the curb assembly by a pivoting member, wherein the cover comprises a liner and an inner structure in contact with the liner, wherein the inner structure includes a support extending within the cover in an edge portion of the cover; and a gas spring laterally positioned within the roof hatch assembly and coupled through the liner between the support and the curb assembly, wherein the gas spring is configured to apply an opening force to the support in the edge portion of the cover to assist opening of the cover relative to the curb assembly without deflecting the cover.

16. The roof hatch assembly of claim 15, comprising a locking mechanism coupled through the support and the liner, wherein the locking mechanism comprises an external handle to enable the cover to be opened from the rooftop of the building.

17. The roof hatch assembly of claim 15, comprising a hold open arm coupled through the liner between the support and the curb assembly.

18. The roof hatch assembly of claim 15, wherein the support comprises a first support, wherein the edge portion comprises a first edge portion, and wherein the inner structure further comprises a second support extending within the cover in a second edge portion of the cover.

19. The roof hatch assembly of claim 18, wherein the inner structure further comprises a third support extending within the cover in a third edge portion of the cover and a fourth support element extending within the cover in a fourth edge of the cover, such that the inner structure extends along a perimeter of the cover.

20. The roof hatch assembly of claim 18, comprising an insulation panel disposed within the cover between the first support and the second support.

21. The roof hatch assembly of claim 15, wherein the cover comprises an exterior cap coupled to a first surface of the support, and wherein the liner is coupled to a second surface of the support.

22. The roof hatch assembly of claim 21, wherein the gas spring comprises a cylinder coupled to a receiving bracket that is coupled to the support through the liner, and wherein the gas spring comprises a piston rod coupled to the curb assembly.

23. A roof hatch assembly for enabling access to a rooftop of a building from an interior of the building, comprising:

a curb assembly configured to be disposed over a curb of the rooftop, wherein the curb is formed around an opening in the rooftop that fluidly connects the interior of the building to an exterior of the building; and a cover coupled to the curb assembly by a pivoting member, wherein the cover comprises an exterior cap, a liner, and an inner structure disposed between the external cap and the liner, wherein the inner structure includes a plurality of supports extending along a perimeter of the cover and an insulation panel disposed within the perimeter of the cover.

24. The roof hatch assembly of claim 23, comprising a gas spring positioned adjacent an edge portion of the roof hatch assembly and coupled through the liner between a support of the plurality of supports and the curb assembly, wherein the gas spring is configured to apply an opening force to the inner structure to assist opening of the cover relative to the curb assembly without deflecting the cover.

25. The roof hatch assembly of claim 24, comprising a hold open arm coupled through the liner between the support and the curb assembly, wherein the hold open arm is configured to enable the cover to be maintained in an open position.

26. The roof hatch assembly of claim 25, wherein the hold open arm comprises a receiving bracket coupled through the liner of the cover to the support, and wherein the gas spring and a handle extension of the hold open arm are coupled to the support via the receiving bracket.

* * * * *